United States Patent [19]

Oka

[11] Patent Number: 4,799,608

[45] Date of Patent: Jan. 24, 1989

[54] TONER CARTRIDGE

[75] Inventor: Seiji Oka, Yokohama, Japan

[73] Assignee: Ricoh Company, Ltd., Tokyo, Japan

[21] Appl. No.: 97,164

[22] Filed: Sep. 16, 1987

[30] Foreign Application Priority Data

Sep. 18, 1986 [JP] Japan ..... 61-143611[U]

[51] Int. Cl.[4] ..... B65D 25/38

[52] U.S. Cl. ..... 222/505; 222/541; 222/559; 222/DIG. 1

[58] Field of Search ..... 222/DIG. 1, 541, 160, 222/162, 504, 505, 561, 559; 206/467, 468, 469; 160/23; 141/364, 366

[56] References Cited

U.S. PATENT DOCUMENTS

| | | | |
|---|---|---|---|
| 3,921,190 | 11/1975 | Ell et al. | 222/541 X |
| 4,561,567 | 12/1985 | Wittstein et al. | 222/541 X |
| 4,614,286 | 9/1986 | Yamaguchi et al. | 222/DIG. 1 |
| 4,647,180 | 3/1987 | Watanabe | 222/DIG. 1 |
| 4,650,070 | 3/1987 | Oka et al. | 222/DIG. 1 |

FOREIGN PATENT DOCUMENTS

| | | | |
|---|---|---|---|
| 102370 | 6/1963 | Norway | 222/504 |

OTHER PUBLICATIONS

Japanese Laid-Open Utility Model Publication (Kokai) No. 61-117170/1986.

*Primary Examiner*—H. Grant Skaggs
*Assistant Examiner*—Nils E. Pedersen
*Attorney, Agent, or Firm*—Oblon, Fisher, Spivak, McClelland & Maier

[57] ABSTRACT

A toner cartridge mounted in a developing device for supplying toner includes a container which stores toner therein. One half of a doubled seal member is stuck to an open portion of the container, and the other half is fixed to a take-up roller which is journalled to the container. A cover is slidably mounted to the container to open and close the open portion of the latter. A rack which is provided on the inner surface of the cover is held in mesh with a gear which is integral with the take-up roller.

12 Claims, 2 Drawing Sheets

TONER CARTRIDGE

BACKGROUND OF THE INVENTION

The present invention relates to a toner cartridge for replenishing additional toner to a developing device.

To eliminate accidental contamination during the supply of toner, there has been proposed a toner cartridge having a toner-storing container therein and constructed such that, after the toner cartridge has been loaded in a developing device, a doubled seal that seals an opening of the container is automatically removed from the opening while a cover that also closes the opening is manually pulled out, as disclosed in Japanese laid-open patent publication (Kokai) No. 59-93471/1984, U.S. Pat. No. 4,650,070 and others. This type of prior art toner cartridge has a problem that the seal cannot be removed beyond half the length of the opening even if the cover is fully pulled out, i.e., the end of the seal has to be manually pulled out over the other half of the opening so as to empty the container.

Another approach to remove the seal is disclosed in Japanese laid-open utility model publication (Kokai) No. 61-117170/1986, U.S. patent application Ser. No. 801,931 filed Nov. 26, 1985, and others. In accordance with this approach, a toner cartridge is provided with a wind-up roller which may be manually rotated from the outside. Specifically, after the toner cartridge has been mounted in a developing device, the roller is rotated from the outside to tear off the seal. While this kind of approach is capable of fully and positively removing the seal, it brings about another problem that an extra space is needed for the roller to be rotated with the toner cartridge loaded in the developing device. Such prevents the toner cartridge from being applied to a wide-use developing device.

SUMMARY OF THE INVENTION

It is, therefore, an object of the present invention to provide an improved toner cartridge which allows a seal to be fully and automatically removed from an opening of a container when a cover is pulled out after the cartridge has been mounted.

It is another object of the present invention to provide a generally improved toner cartridge.

A toner cartridge of the present invention comprises a container storing toner therein and having an opening formed therethrough, a seal member having a first portion which is sticked to the container to close the opening, and a second portion turned up to extend along and below the first portion, a take-up means provided in the container for taking up the second portion of the seal member to thereby sequentially tear off the first portion of the seal member, thereby discharging the toner from the container, a protective cover mounted on the container to be slidable along the opening of the container for protecting the seal member, and a drive means for driving the take-up means in accordance with a sliding movement of the protective cover to allow the seal member to be fully removed from the opening of the container.

The above and other objects, features and advantages of the present invention will become more apparent from the following detailed description taken with the accompanying drawings.

DESCRIPTION OF THE PREFERRED EMBODIMENT

Figure 1:
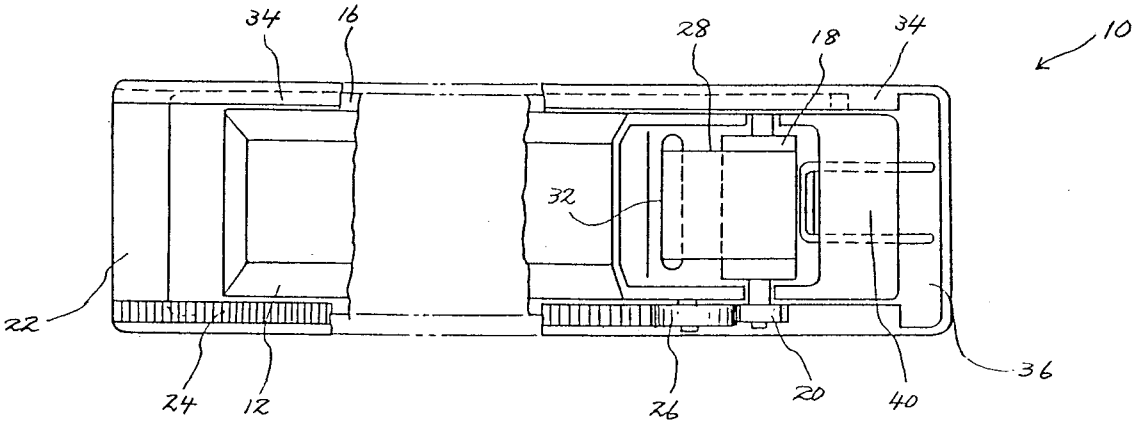
FIG. 1 is a top view of a toner cartridge embodying the present invention.
Figure 2:
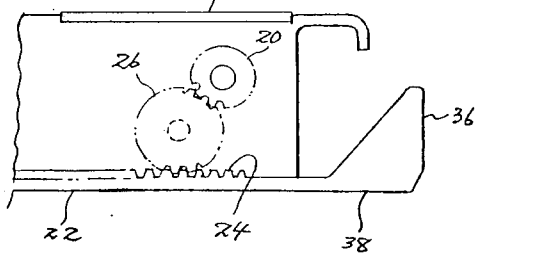
FIG. 2 is a section of the toner cartridge as shown in FIG. 1.
Figure 3:
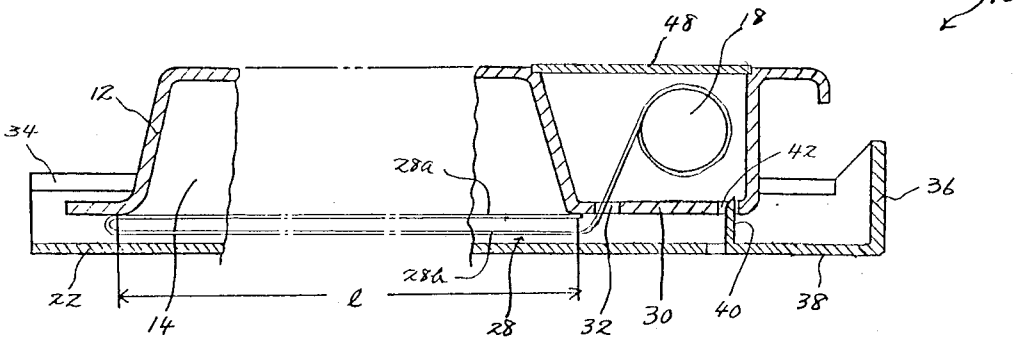
FIG. 3 is a sectional side elevation of the toner cartridge as shown in FIG. 1.
Figure 4:
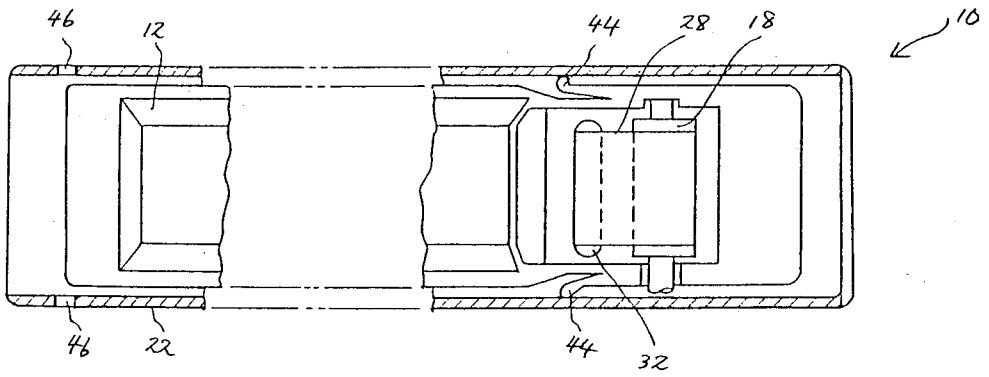
FIG. 4 is a sectional plan view of the toner cartridge as shown in FIG. 1.

Referring to FIGS. 1 to 4 of the drawings, a toner cartridge in accordance with the present invention is shown and generally designated by the reference numeral 10. As shown, the toner cartridge 10 includes a container 12 which is formed with an opening 14 at one surface thereof. A pair of projections 16 protrude sideways and outward from the container 12 at opposite sides of the opening 14. Journalled to one of longitudinally opposite ends of the container 12 are a take-up roller 18 and an idle gear 26. The take-up roller 18 is provided with a gear 20 at one end thereof. The idle gear 26 intervenes between the meshes with the gear 20 and a rack 24 which is provided on the inner surface of a cover 22, which will be described. A seal member 28 which is more than two times greater in length than the opening 14 of the container 12 is positioned to close the opening 14. Specifically, as shown in FIG. 3, one half **28*a* of the seal member 28 is stuck to the container 12 around the opening 14 and from that part of the container 12 where the gears 20 and 26 are journalled (hereinafter referred to as a gear journalling part) to the other end of the container 12, whereby the opening 14 is sealed. The other half 28*b* of the seal member 28 is turned down to extend along and below the former half 28*a*, then passed through a slot 32 which is formed through the bottom 30 of the gear journalling part of the container 12, and then stuck to the periphery of the take-up roller 18**.

The previously mentioned cover 22 is positioned to close the opening 14 of the container 12 from the outside of the seal member 28. The cover 22 is provided with a generally U-shaped bend 34 which extends along the length of the cover 22 and at each of opposite sides of the cover 22. These bends 34 are individually mated with the pojections 16 so that the cover 22 may slide in the longitudinal direction on and along the container 12. While the cover 22 is caused to slide as mentioned, the rack 24 provided on one side of the inner surface of the cover 22 and meshed with the idle gear 26 drives the idle gear 26 and, thereby, the take-up roller 18 in a rotational motion.

A handle portion 36 extends out from the cover 22 on the pull-out side of the latter, i.e., in the vicinity of the gear journalling part of the container 12. The end 38 of the handle portion 36 is cut and raised to form a cantilever-like hook 40. The end of the hook 40 is received in a perforation of the bottom 30 of the gear journalling part of the container 12. Further, perforations 46 are formed through those opposite sides of the cover 22 which extend along the length of the cover 22, and lugs 44 are protruded from opposite sides of the container 12. When the cover 22 is fully pulled out, the perforations 46 of the cover 22 are individually mated with the lugs 44 of the container 12. As shown in FIG. 3, the bore of the container 12 in which the roller 18, gear 20 and idle gear 26 are received is closed at its top by a lid 48. If desired, the lid 48 may be replaced with a transparent seal member to allow one to observe those structural elements.

In the above construction, while the toner cartridge 10 is in a usual condition for storage or transport, the opening 14 is closed by the seal member 28 and, further, by the cover 22 from the outside of the seal member 28. when it is desired to replenish additional toner to a developing device, the container 12 is placed above a hopper with the opening 14 faced downward and, then, fixed in place by a locking member, not shown. Subsequently, the hook 40 is pressed from above to be released from the perforation 42 and, then, the cover 22 is pulled out with the handle portion 36 gripped by hand. While the cover 22 is moved so, the idle gear 26 which is meshed with the rack 24 of the cover 22 is rotated to in turn rotate the gear 20. As a result, the tak-up roller 18 which is integral with the gear 20 is rotated to wind the seal member 28 therearound to thereby uncover the opening 14 of the container 12, whereby toner is fed from the container 12 into the developing device.

Assume that the opening 14 of the container 12 has a length l, FIG. 3, and the seal member 28 which stops the opening 14 has a length 2l. A condition for allowing the seal member 28 to be fully taken up by the take-up roller 18 while the cover 22 is pulled out by an amount which corresponds to the length l of the opening 12 will be described hereinafter.

Assume that the length of the opening 14, i.e., the length of that part 28*a* of the seal member 28 which closes the opening 14 is l, the diameter of the wind-up roller 18 is D, and the number of revolutions, the number of teeth and the module of the idle gear 26 are $n_1$, $z_1$ and m, respectively. To cause the entire seal member 28 to be taken up by the sliding movement of the cover 22, the number of rotations $n_2$ of the take-up roller 18, i.e., that of the gear 20 is determined as expressed by:

$$2l=\pi\cdot D\cdot n_2$$

therefore $$n_2=2l/(\pi\cdot D) \qquad \text{Eq. (1)}$$

The number of revolutions $n_1$ of the idle gear 26 at the instant when the cover 22 has been slid by the distance l is given by:

$$l=\pi\cdot z_1 m\cdot n_1$$

therefore $$n_1=l/(\pi\cdot z_1 m) \qquad \text{Eq. (2)}$$

Assuming that the ratio between $n_1$ and $n_2$ is $\eta$, then $$n_1\eta=n_2 \qquad \text{Eq. (3)}$$

Substituting the Eqs. (1) and (2) for the Eq. (3), there holds:

$$\frac{l}{\pi\cdot z_1 m}\eta=\frac{2l}{\pi\cdot D}$$

therefore $$D=2z_1 m/(\eta) \qquad \text{Eq. (4)}$$

All that is required is, therefore, so selecting the various parameters as to satisfy the Eq. (4).

After the container 12 has been emptied by the previously described procedure, the cover 22 is pushed into the developing device again. This time, the rack 24 on the cover 22 rotates the idle gear 26 and roller 18 in the opposite direction until the cover 22 regains the position where it closes the opening 14. Finally, the container 12 is removed from the developing device with no toner scattered around.

While the above embodiment has been shown and described as rotating the take-up roller 18 through the idle gear 26 which is meshed with the rack 24 of the cover 22, the gear 20 which is integral with the roller 18 may be directly meshed with the rack 24, provided a space wide enough to accommodate the wind-up roller 18 having a sufficiently large diameter is available and the number of teeth of the gear 20 which is integral with the roller 18 can be reduced as far as possible.

Further, the gears stated above may be replaced with friction rollers or even with any other kind of link mechanism.

In summary, it will be seen that the present invention provides a toner cartridge in which an opening of a container is closed by a seal member and, further, by a cover from the outside of the seal member, so that damage to the seal member and, therefore, scattering of toner is eliminated even if another object touches the cartridge while the cartridge is in storage or the like. Further, because the arrangement is such that the seal member which is doubled is fixed at its other end to a take-up roller, which is integral with a gear, and the roller is rotated interlocked to an outward movement of the cover through the gear, the seal member is fully and automatically removed from the opening to exhaust the container when the cover is pulled out, only if the number of teeth of the gear and the diameter of the take-up roller are adequately selected. In addition, after the cover has been restored to its position for closing the opening of the container, the container may be removed from the developing apparatus without allowing any toner to be scattered around.

Various modifications will become possible for those skilled in the art after receiving the teachings of the present disclosure without departing from the scope thereof.

What is claimed is:

1. A toner cartridge comprising:

a container storing toner therein and having an opening formed therethrough;

a seal member having a first portion which is stuck to said container to close said opening, and a second portion turned up to extend along and below said first portion;

a take-up means provided in said container for taking up said second portion of said seal member to thereby sequentially tear off said first portion of said seal member, thereby discharging the toner from said container;

a protective cover mounted on said container to be slidable along the opening of said container for protecting said seal member; and a drive means separate from said take-up means for driving said take-up means in accordance with a sliding movement of said protective cover by an amount sufficient to allow said seal member to be fully removed from said opening of the container.

2. A toner cartridge as claimed in claim 1, wherein said take-up means comprises a take-up roller for taking up said seal member.

3. A toner cartridge as claimed in claim 2, wherein said drive means comprises a rack which is provided on said protective cover, an idle gear meshed with said rack to be rotated when said protective cover is slid, and a driven gear mounted on said take-up roller to be rotated by said idle gear.

4. A toner cartridge as claimed in claim 3, wherein a condition for causing said first portion of said seal member, which closes the opening of said container, to be fully removed by the sliding movement of said cover is $D=2z_1m/\eta$ where D is a diameter of said take-up roller, $z_1$ is a number of teeth of said idle gear, $\eta$ is a ratio in rotation speed between said idle gear and said driven gear, m is a module of said idle gear and said driven gear.

5. A toner cartridge as claimed in claim 1, wherein said take-up means and said drive means are accommodated in a space which is defined at the outside of said container and provided with an opening formed through said container.

6. A toner cartridge as claimed in claim 5, further comprising a lid member for closing the opening of said space.

7. A toner cartridge as claimed in claim 6, wherein said lid member comprises a transparent seal.

8. A toner cartridge comprising:

a container storing toner therein and having an opening formed therethrough;

a seal member having a first portion which is stuck to said container to close said opening, and a second portion turned up to extend along and below said first portion;

a take-up means provided in said container for taking up said second portion of said seal member to thereby sequentially tear off said first portion of said seal member, thereby discharging the toner from said container, said take-up means comprising a take-up roller for taking up said seal member;

a protective cover mounted on said container to be slidable along the opening of said container for protecting said seal member; and a drive means for driving said take-up means in accordance with a sliding movement of said protective cover.

9. A toner cartridge as claimed in claim 8, wherein said drive means comprises a rack which is provided on said protective cover, an idle gear meshed with said rack to be rotated when said protective cover is slid, and a driven gear mounted on said take-up roller to be rotated by said idle gear.

10. A toner cartridge as claimed in claim 9, wherein a condition for causing said first portion of said seal member, which closes the opening of said container, to be fully removed by the sliding movement of said cover is $D=2z_1m/\eta$ where D is a diameter of said take-up roller, $z_1$ is a number of teeth of said idle gear, $\eta$ is a ratio in rotation speed between said idle gear and said driven gear, m is a module of said idle gear and said driven gear.

11. A toner cartridge comprising:

a container storing toner therein and having an opening formed therethrough;

a seal member having a first portion which is stuck to said container to close said opening, and a second portion turned down to extend along and below said first portion;

a take-up means provided in said container for taking up said second portion of said seal member to thereby sequentially tear off said first portion of said seal member, thereby discharging the toner from said container;

a protective cover mounted on said container to be slidable along the opening of said container for protecting said seal member;

a drive means for driving said take-up means in accordance with a sliding movement of said protective cover, said take-up means and said drive means being accommodated in a space which is defined outside of said container and provided with an opening; and a lid member for closing the opening of said space.

12. A toner cartridge as claimed in claim 11, wherein said lid member comprises a transparent seal.

* * * * *